United States Patent [19]

Bisczat et al.

[11] 4,272,205

[45] Jun. 9, 1981

[54] SIGNAL CONTROLLED INDEXING RATE SHIFTER FOR A TYPEWRITER

[75] Inventors: John J. Bisczat; Charles D. Bleau, both of Lexington, Ky.

[73] Assignee: International Business Machines Corporation, Armonk, N.Y.

[21] Appl. No.: 945,953

[22] Filed: Sep. 26, 1978

[51] Int. Cl.[3] ..... B41J 19/76

[52] U.S. Cl. ..... 400/575; 400/549; 400/550; 400/568; 400/639.1

[58] Field of Search ..... 400/549, 550, 568, 569, 400/570, 572, 573, 575, 578, 582, 598, 636, 636.1, 639.1, 639.2; 364/200

[56] References Cited

U.S. PATENT DOCUMENTS

| | | | |
|---|---|---|---|
| 2,204,243 | 6/1940 | Anderson | 400/639.1 X |
| 2,210,168 | 8/1940 | Hart | 400/639.2 X |
| 2,353,407 | 7/1944 | Kurowski | 400/636 X |
| 2,463,259 | 3/1949 | Giauque | 400/550 |
| 2,711,811 | 6/1955 | Lambert | 400/578 X |
| 2,791,311 | 5/1957 | Yerks et al. | 400/568 X |
| 3,276,562 | 10/1966 | Mathews | 400/549 |
| 3,292,762 | 12/1966 | Erickson | 400/550 |
| 3,326,348 | 6/1967 | Cralle et al. | 400/569 X |
| 3,960,258 | 6/1976 | Aebi | 400/550 |
| 4,031,995 | 6/1977 | Blum et al. | 400/636.1 |
| 4,057,846 | 11/1977 | Cockerill et al. | 364/200 |
| 4,087,852 | 5/1978 | Campbell et al. | 364/200 |

OTHER PUBLICATIONS

IBM Technical Disclosure Bulletin, "2-3-6 Lines/Inch Platen Indexing Method," Becker, vol. 17 No. 8, Jan. 1975, pp. 2355-2356.

*Primary Examiner*—Ernest T. Wright, Jr.
*Attorney, Agent, or Firm*—George E. Grosser

[57] ABSTRACT

An indexing mechanism for a typewriter provides a signal controlled transfer to a fast paper advance rate, say for semi-automatic paper insertion, while storing the last operator-selected rate. Two cams are employed which influence, through a follower, the engagement point of a pawl of a pawl and ratchet platen drive. One cam is operator positionable to change the portion of its cam profile that is tracked by the follower and, attendantly, the paper advance rate. By arranging a signal-controlled actuator to deflect the positionable cam from operative engagement with the follower, the outer cam, which has a less prominent profile, is enabled to influence the pawl engagement point and provides high speed paper advance. Upon removal of the actuator signal the positionable cam is automatically returned to its operative position i.e., the last operator selected position.

7 Claims, 11 Drawing Figures

INPUT OF FIRST LINE CODE USING NUMBER KEYS

SIGNAL CONTROLLED INDEXING RATE SHIFTER FOR A TYPEWRITER

BACKGROUND OF THE INVENTION

1. Field of the Invention

The invention relates generally to paper handling for a typewriter and, more particularly, to apparatus for advancing a sheet of paper to a desired first line printing position.

2. Statement Regarding the Prior Art

Various apparatus has been proposed and implemented for semi-automatically inserting paper into a typewriter. Generally, however, such apparatus has had limited appeal because complicated special purpose mechanisms were required that unduly increased machine costs and because the operator was required to learn a somewhat involved procedure to achieve a result that could be accomplished manually with only a moderate effort.

The increase in costs and complexity arises because provision must be made for operator indication of the desired first line printing position and because the paper path must be prepared for paper insertion, for example, by moving a paper hold-down device at the printing line out of the paper path so as not to interfere with the leading edge of the incoming page (or pack including carbons).

Also, from a cost standpoint it would be desirable to use the normal typewriter indexing mechanism for paper advance. A problem arises, however, because the operator may select various indexing rates and, consequently, a commanded number of indexing operations does not correspond to a particular advance distance rather, the distance will reflect the operator selection. Moreover it is not desirable to disturb the operators indexing rate selection, but it is desirable to achieve the maximum paper input speed.

SUMMARY OF THE INVENTION

A mechanism for incrementally advancing paper present at the paper feed path of a typewriter uses a first cam profile to establish an operator-selectable advance increment and achieves signal controlled transfer to a rapid advance cam, for say paper insertion, while retaining the operator selected indexing rate for normal operation. Once the signal for transferring to the "rapid cam", is removed, the mechanism automatically returns, for the next paper advance cycle, to the first cam and the last operator selected indexing rate.

The cams serve to influence the advance rate by coaction with a follower to control the path of the pawl of a ratchet-pawl indexing arrangement for the typewriter platen. Selectability of indexing rate is achieved by moving the first cam to change the portion of the cam profile engaged by the follower. The first cam preferably has a relatively prominent profile and, when in operative position, prevents the follower from tracking along the rapid cam profile. A signal controlled actuator is provided, preferably the armature of an electromagnet, to deflect the first cam from the path of the follower, which then tracks the rapid cam. For the presently preferred implementation, a spring biases the first cam in a direction for returning to the operative position in the absence of opposing force from the electromagnet. The rate selection motion is preferably chosen to be generally in the direction of pawl motion and the deflection motion direction is chosen to be perpendicular to the selection motion direction to assure independence of motion.

The invention will now be described with respect to a preferred implementation, which is in the environment of a semi-automatic paper insertion device for a typewriter, and with reference to the drawing wherein.

Figure 4A:
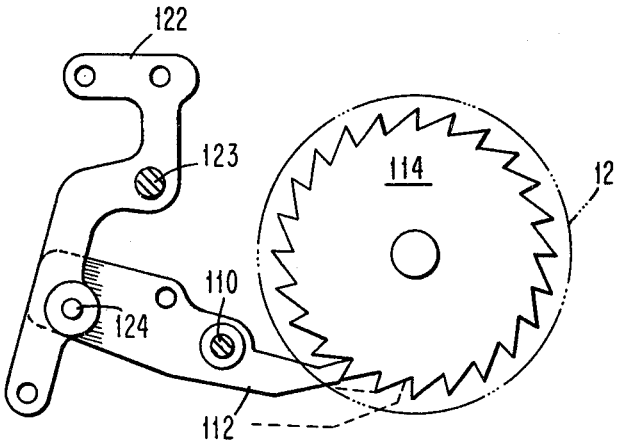
FIG. 4 is a cutaway representation in perspective of a indexing mechanism, according to the invention, that permits special paper advance for paper insertion at a triple line rate without the loss of the operator selected line advance setting for normal operation.
Figure 10:
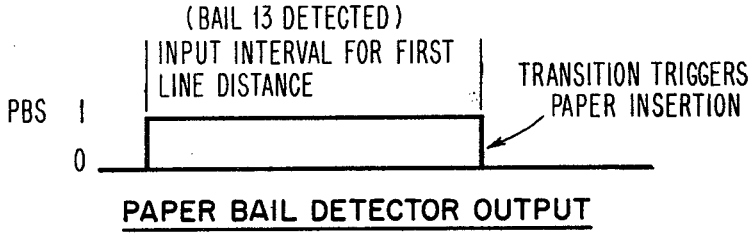
Figure 4:
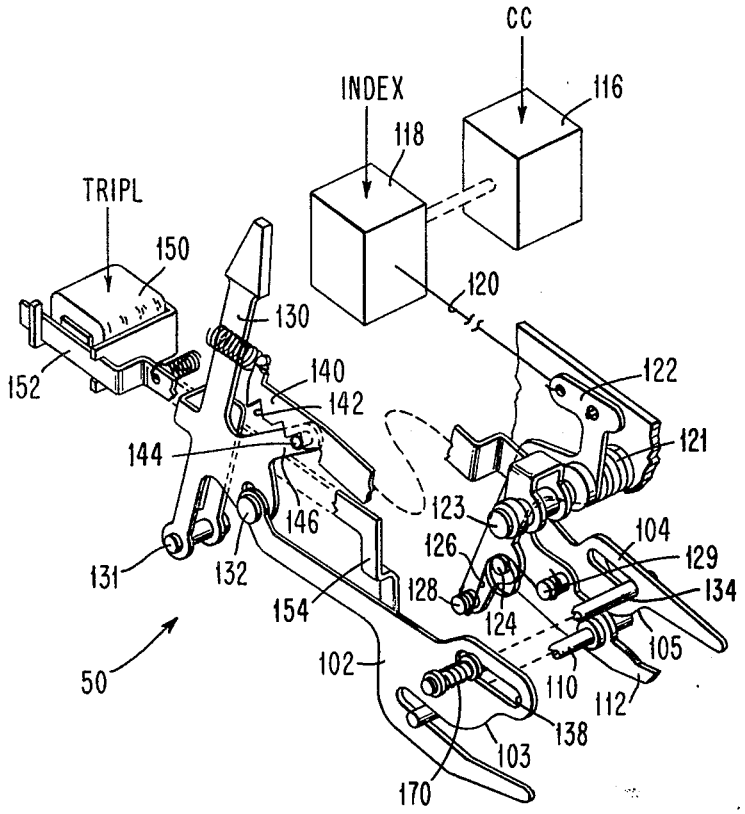
Figure 5:
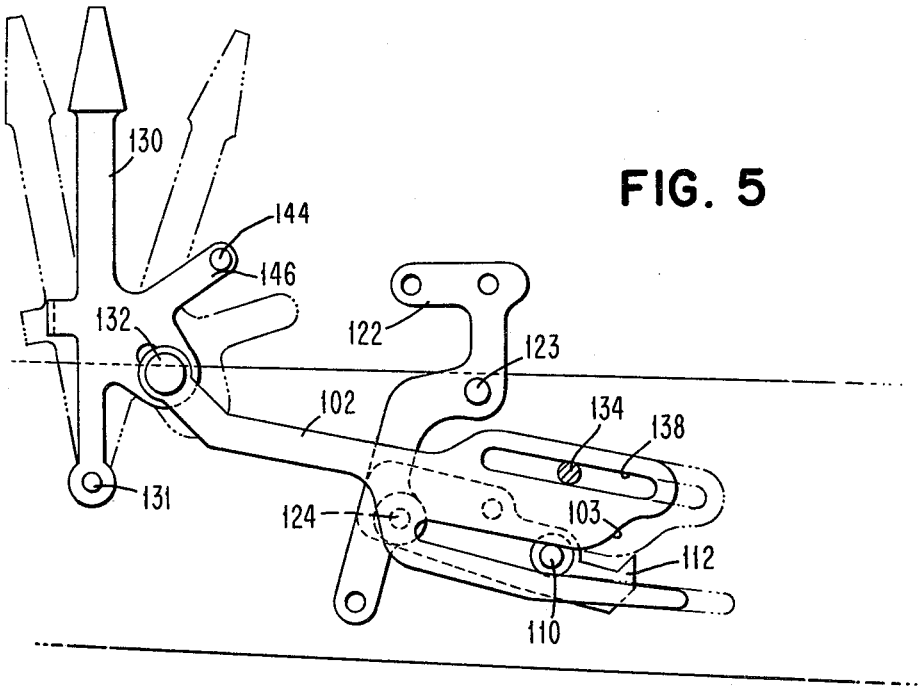
Figure 6:
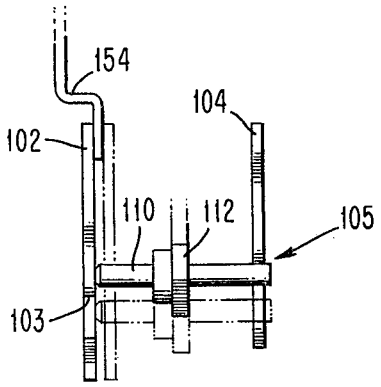
Figure 7:
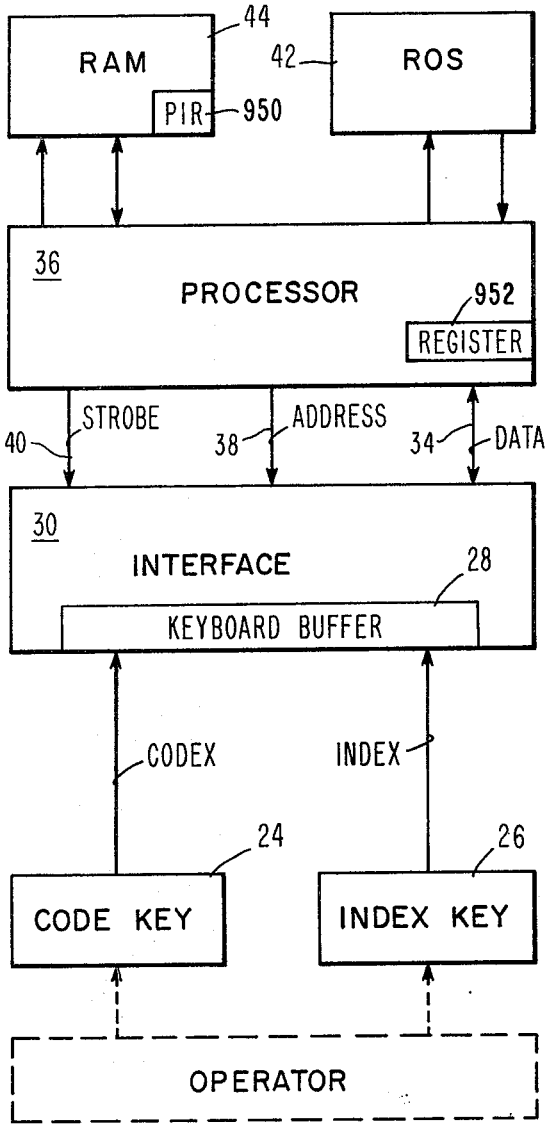
Figure 8:
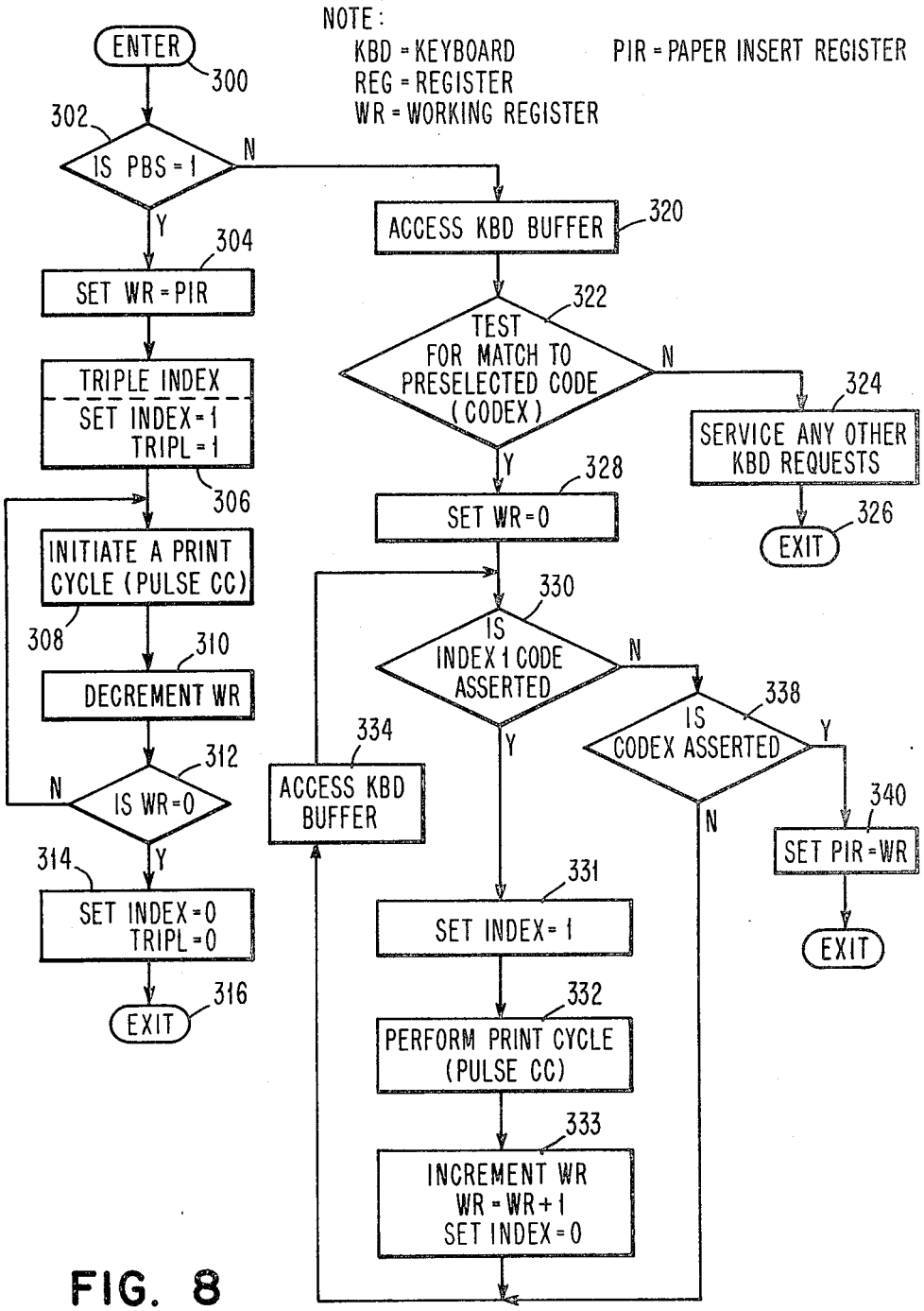
Figure 9:
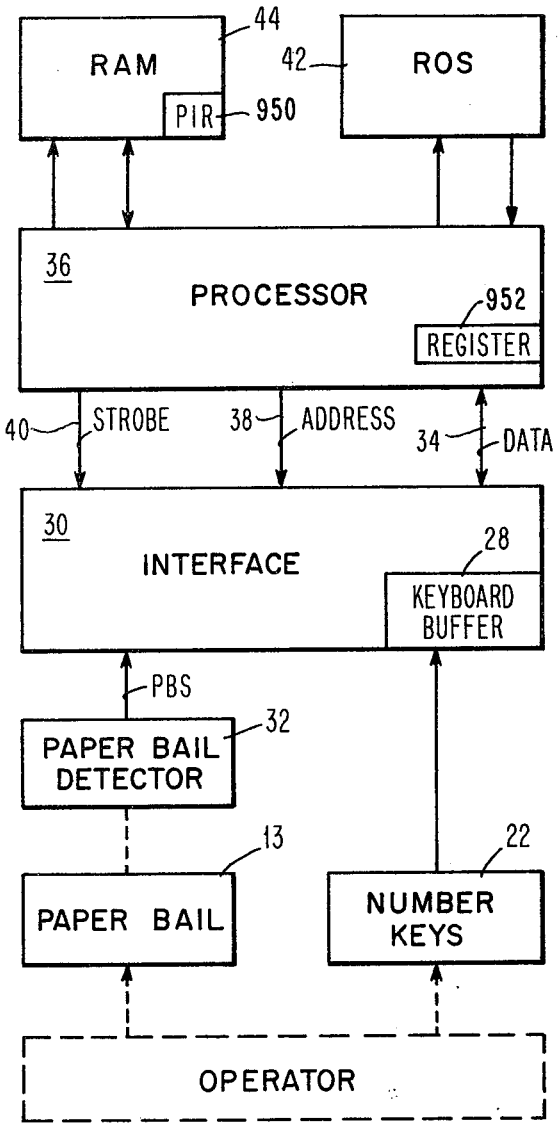
Figure 11:
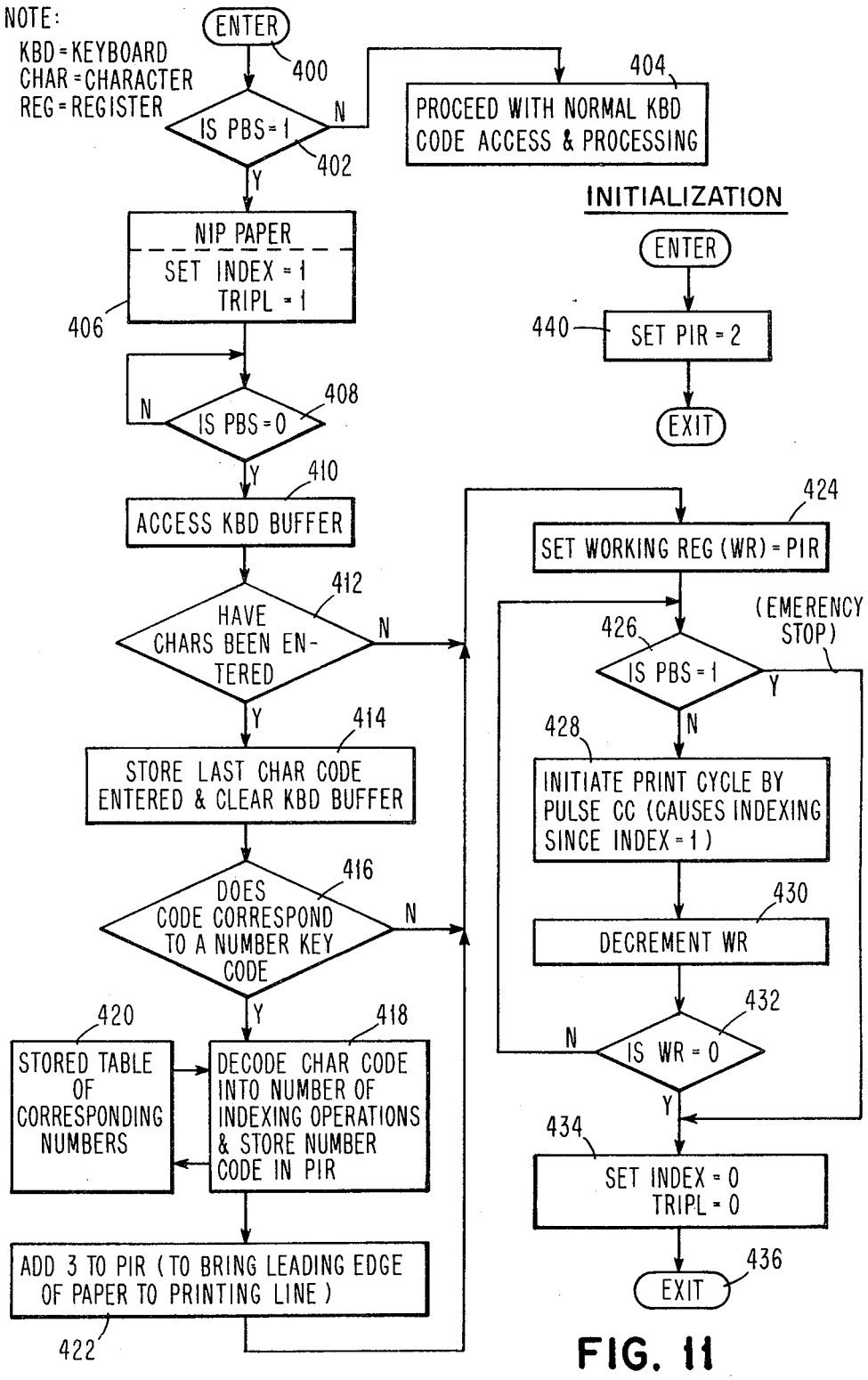

FIG. **4*a* is a side view showing detail of the pawl and ratchet for the mechanism of FIG. 4**;

FIG. 5 is a side view showing detail of the line advance selection for the mechanism of FIG. 4;

FIG. 6 is an end view showing detail of cam surface transfers for the mechanism of FIG. 4;

FIG. 7 is a diagram in block form indicating an input arrangement for a first line distance code;

FIG. 8 is a flow diagram indicating the sequential logic for the arrangement of FIG. 7;

FIG. 9 is a diagram in block form indicating first line distance input arrangement;

FIG. 10 is a diagram indicating significant signal intervals for the arrangement of FIG. 9; and FIG. 11 is a flow diagram indicating the sequential processing for the arrangement of FIG. 9.

Figure 1:
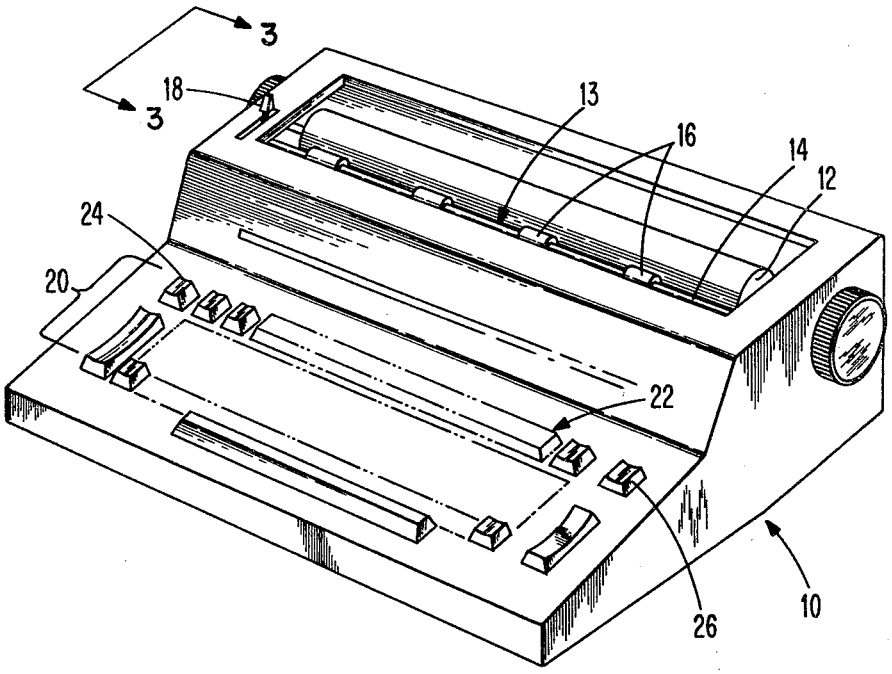
FIG. 1 is a perspective view of a typewriter suitable for incorporating the invention.
Figure 2:
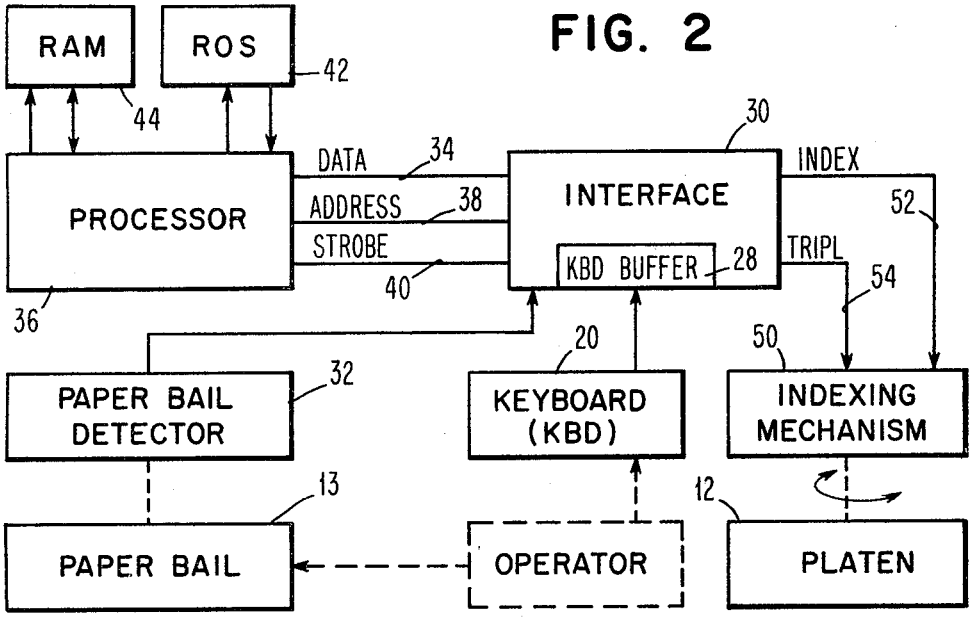
FIG. 2 is a system diagram in block form indicating basic signal flows for a paper insertion apparatus serving as an environment for the invention.

Referring to FIG. 1, a typewriter 10 suitable for use with the invention includes a platen 12 and a paper hold-down device 13 such as a paper bail, 14 which supports a set of rollers 16 and is coupled to a control lever 18. Signals representing character printing and functional commands are generated by a keyboard 20 having various keys including a set of number keys 22, a code key 24 and an index key 26. Signal flow among various instrumentalities of the typewriter 10 (indicated in FIG. 2) is generally initiated by the typewriter operator who, as is indicated by dashed lines, interacts with keyboard 20 to produce coded signals which are supplied to a keyboard buffer 28 of an interface device 30. Manipulation of the paper bail lever 18, as is described in detail below, causes a detector 32 to produce signals that are supplied to the interface device 30. At the interface device 30, signal information is buffered for transmission over a set of data lines 34 to a processor 36, such transmission being in response to respective addresses asserted on an address bus 38 in conjunction with a timing or strobe signal 40 as is well known in the art. While decoding and buffering is centralized in the interface device 30 as shown (such as interface can, for example be employed with a processor having the bus structure described in U.S. Pat. No. 4,057,846) it will be appreciated that individual interface devices could be employed at the input and output devices, such as the keyboard 20, as is described in U.S. Pat. No. 4,087,852. The processor 36 is adapted to perform various basic logic functions and a read only storage (ROS), 42 incorporates the sequence of basic processor operations to be performed in the form of physical structures, as is known in the art. In performing such sequences or procedures, accessable code storage is occasionally required as provided by a read/write memory (RAM) 44.

Signals are sent from the processor 36 over the data lines 34 to the interface device 30 for controlling various output devices (again selected by corresponding addresses asserted on address bus 38), for example, character selection apparatus (not shown) and an indexing device 50 which is mechanically coupled to drive the platen 12. In particular, addresses are assigned to an INDEX command signal 52 and a TRIPL command signal 54, which signals are supplied to the indexing device 50 via the interface device 30 (which decodes the addresses to select the corresponding output channel) to cause an indexing operation and a shift to triple space increments respectively as is discussed in more detail below.

Figure 3:
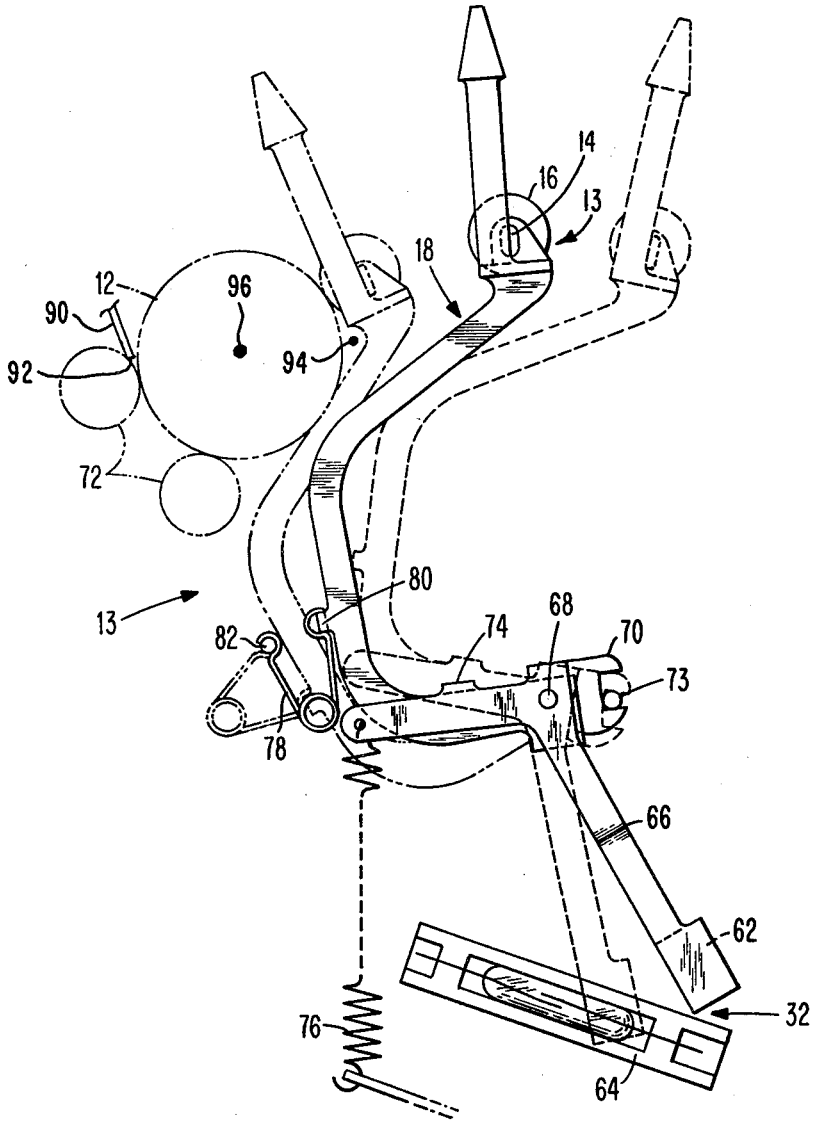
FIG. 3 is a sectional representation, viewed along the line 3—3 of FIG. 1, for a paper hold-down device with associated detector for use as part of the environment of the invention.

Referring to FIG. 3, a paper hold-down device 13 cooperates with a detector 32 having a magnet 62 and a reed switch 64 that is rigidly mounted to the typewriter frame (not shown). The magnet 62 is attached to an arm 66 that is pivoted at a pin 68 and includesa motion-limiting notched tab 70 that cooperates with a pin 73. Motion is transmitted to the arm 66 by engagement of the paper bail lever 18 with a tab 74. The lever 18 pivots about the pin 68 and is selectively moveable to three significant positions: a paper hold-down position (phantom lines), a stable withdrawn position (solid lines) and an unstable extreme withdrawn position (dashed lines). In the extreme ("detection") position the arm 66 is driven against the opposing force of a spring 76 to a position where the field of magnet 62 influences the reed switch 64 to assume a conducting state and the spring force causes the position to be unstable. For the stable withdrawn position lever 18 is held in place by a toggle spring 78 that is connected between a tab 80 and a fixed pin 82. In the paper hold-down position, lever 18 is urged by the spring 78 for biasing paper bail rollers 16 against the platen 12, which in cooperation with sets of feed rollers 72 defines a paper feed path.

A receiving medium 90, typically a sheet of paper, is indicated at a paper entrance 92 defined at the nip of the rollers 72 and platen 12. As is conventional, a printing line 94 of the typewriter 10 is established parallel to the longitudinal axis 96 of the platen 12. Character formation occurs along the printing line 94 during printing operation of typewriter 10 and various well known printing mechanisms (not shown) may be employed to form characters, e.g. a ball element printer or a ballistic wire printer.

Referring to FIGS. 4 and 4*a*, a presently preferred indexing mechanism 50 includes a first cam element 102 with a profile surface 103 for use in normal indexing operation and a second cam element 104 with a profile surface 105 that provides high speed indexing for paper insertion. A pin 110 serves as the cam follower and is affixed to a pawl 112 for controlling the point at which the pawl 112 engages a ratchet wheel 114 that is connected to the platen 12 (the longer the engagement the greater the advance increment). Drive motion for the pawl 112 is transmitted from a drive shaft (not shown) through a cycle clutch 116 to an indexing clutch 118 and then through a linkage 120 to a pivoted pawl carrier 112 that is rotatable about a pin 123 and is biased to pull against the linkage 120 by a spring 121. Cycles of operation are initiated by the signal CC which is supplied to the cycle clutch 116 as is well known in the art. Pawl carrier 122 is connected to the pawl 112 by a pin 124 and a spring 126 tensioned between studs 128 and 129 serves to urge the pawl toward the profile surfaces 103 and 105 respectively of the cam elements 102 and 104. The drive motion causes pawl 112 to reciprocate (a forward pawl position is indicated in dashed lines in FIG. 4*a*) and the extent of the cam profile 103 engaged by the pin 110 is manually adjustable by the operator by means of a selection lever 130 pivoted about a pin 131. Coupling of the cam element 102 to selection lever 130 is accomplished by means of a pin 132 and motion of the cam element 102 is constrained by a fixed pin 134 which passes through a slot 138 (see also FIG. 5, where dashed lines indicate alternate cam position selections for the cam element 102).

Discrete indexing positions are established by a detent bar 140 (see also FIG. 4) which is spring biased about the pivot pin 123 to engage, at a detented edge 142, a pin 144 which is arranged on an arm 146 of the selection lever 130. For the normal or operative position of cam element 102, profile surface 103 is forward of or in line with profile surface 105 and hence controls the engagement point of pawl 112. Transfer of follower 110 from cam element 102 to cam element 104 is effected by means of an electromagnet 150 having armature 152 with an extended arm 154 that, when moved to an actuated position, engages and deflects the cam element 102 laterally (see FIG. 6). Activation of electromagnet 150 is effected by a signal denoted TRIPL and in the absence of an activating signal level to cause deflection of arm 154, a spring 170 provides force to urge cam element 102 to the normal position for camming engagement with the follower pin 110. Whenever the signal TRIPL activates electromagnet 150, the follower pin 110 is urged against the generally less prominent profile surface 105 (see FIG. 6), which permits the pawl 112 to engage the ratchet wheel 114 over a relatively long portion of the pawl stroke and provides a three line indexing increment. The engagement point for such three line increment operation is, of course, essentially the same as would occur with cam profile 103, if the operator selects a three line increment using the lever 130.

Referring to FIG. 7, signal flow for input of a first line distance code is initiated, for one embodiment of the invention, by operator depression of the code key 24 (or the code key 24 in conjunction with another key say the "X" key) which produces a code signal that triggers a sequence of processor logic for counting pulses produced as a result of the operator depression of the index key 26. Counting continues until the next subsequent depression of the code key 24, at which time the count total is stored at a location (denoted PIR) 950 in the RAM 44. The sequence of basic logic operations performed by processor 36 to effect such storage is defined by the physical structure of the ROS 42 and is best described to those skilled in the art in terms of a flow chart which may be straightforwardly converted into a ROS structure to cooperate with a chosen type of processor 36. Referring to FIG. 8 the logic (for the embodiment of FIG. 7) starts (block 300) at an entry point from an overall servicing loop (not indicated) for input signals e.g., the loop logic checks for and accesses all of the possible input signals from the keyboard 20 and any detector (e.g. detector 32) or other signal source in a predefined sequence or with a predefined priority on an interrupt basis. A test (block 302) is made to determine the state of the signal PBS from the detector 32 (See FIG. 3). If the test indicates a detection, the contents of the paper index register (PIR) 950 in the RAM 44 are duplicated (block 304) in a working register 952 of the processor 36 (see also FIG. 7). To prepare for triple indexing (see also FIG. 4), the binary output signals to the indexing device 50, INDEX and TRIPL, are set to the "one" state (block 306). Triple indexing according to the value stored in the register 952 is triggered in a register decrementing logic loop (blocks 308–312) and when indexing to the desired first line position is completed the binary output signals INDEX and TRIPL are set to zero (block 314) and the sequence is exited (block 316) to the overall input signal servicing loop mentioned above.

If the test at block 302 fails the paper bail detector 32 is not activated and the logic sequence proceeds to access the keyboard buffer 28 (block 320). A test is performed (block 322) to determine whether or not a triggering code denoted CODEX (e.g., a code produced by depression of the "CODE" key 24 or a code produced by depressing the "CODE" key 24 such as the "X" key not specifically shown) in conjunction with another key has been asserted. If not, other keyboard requests from buffer 28 are serviced (block 324) and the sequence returns to the overall input servicing loop (block 326).

If CODEX is found to be asserted (see block 322), working register 952 is initialized (block 328) for counting and is incremented each time an indexing operation is requested by means of the key 26 (blocks 330–334). Such a key depression occurance is indicated by a particular preselected character code at the keyboard buffer 28 and the processor output INDEX is responsively set to the "one" state (block 331). The necessary print cycles are triggered by e.g., pulsing the signal CC to the cycle clutch (element 116, FIG. 4). Such use of the cycle clutch 116 is well known in the typewriter art for power take-off from a drive shaft. If multiple print cycles are required for an indexing operation a flag can be set in a register to account for the second cycle.

Once the print cycles are finished e.g., as indicated by a time interval elapsed or by a feedback signal, the working register 952 is incremented and the signal INDEX is set to the zero state (block 333). If the test (block 330) indicates that no index code has been asserted, a test (block 338) is made for the CODEX code, which, preferably, also serves to signal the end of the input interval. If the CODEX code is asserted, the total in the working register 952 is stored (block 340) in the PIR location 950 of the RAM 44 and a return occurs to the overall input service loop (discussed below). Otherwise, the keyboard buffer 28 is checked for a new code (a second path to block 334).

Referring to FIG. 9, a presently preferred signal processing arrangement for operator input of a first line distance code utilizes the signal PBS of detector 32 to trigger a conditioning of the processor 36 to receive distance information from the keyboard 20 (FIG. 1). Such distance information, preferably number key codes, is decoded using a stored conversion table or procedure. Corresponding codes representing indexing increments to achieve the desired first line are produced and are stored in the PIR location 950 of RAM 44. Preferably, the transition in the state of signal PBS when the paper bail 14 is transferred from the detection position (see also FIGS. 3 and 10) causes the processor 36 to access by the code stored at PIR location 950 and command a corresponding number of indexing operations.

The signal processing sequence that is dictated by the structure of the ROS 42, and causes operation according to the invention under control of the processor 36, is now considered with reference to the diagram of FIG. 11. The presently preferred paper insert operational sequence is entered (block 400) from the overall input servicing (or polling) loop implemented by processor 36 (mentioned above) and begins with a test (block 402) to determine the detection state of detector 32. If the paper hold down device 13 is not in the detection position (see also FIG. 3), normal processing of the coded signals from keyboard 20 proceeds (block 404), as is well known in the art. By this comparator operation the processor 36 effectively disables or circumvents normal keyboard signal processing if the signal PBS is in the detection state (assumed here to be the logic "one" state). For the detection state of signal PBS, a triple index is triggered (block 406) to nip paper presented at the paper entrance 92 (to free the operator's right hand from holding the paper in place).

A delay is interposed (block 408) until the paper hold down device 13 is released from the detection position, as indicated by the signal PBS assuming the logic "zero" state, and then the keyboard buffer 28 is accessed (block 410) to determine if the operator has performed any keyboard operations while the paper hold down device 13 was in the detection position (block 412). If so, the last character code entered is accessed and the buffer 28 is cleared (block 414). The character code is then tested to determine if, in particular, a code corresponding to one of the number keys 22 has been asserted (block 416), this in accordance with the presently preferred implementation for the invention. Such number code is then decoded (block 418) using a table (block 420) stored in the ROS 42 to produce a code representing a preselected number of indexing operations, e.g., the "2" key code preferrably corresponds to two triple indexes. To account for the paper path distance to bring the leading paper edge to the printing line 94 (FIG. 3), a fixed number of indexing operations is added (block 422) to the stored number. At this point or previously if no valid characters were entered (a failure of either the block 412 or block 416 test), the value from the PIR location 950 is duplicated in the working register 952 (block 424).

In a repeated loop (blocks 426, 428, 430, and 432), indexing operations are triggered and the total in the register 952 is decremented with each indexing operation until the register total is reduced to zero (block 432).

An emergency stop is provided, for enhancement of operator control, and is triggered (block 426) if the paper bail 14 is again moved to the detection position. Once one of the loop tests (block 426 or 432) is satisfied, an emergency stop has occurred or the desired paper insertion has been completed and the output signals INDEX and TRIPL are reset (block 434) to logic "zero" followed by a return to the overall input servicing loop (block 436).

As a further enhancement, an initialization procedure is included in the normal logic operations when the machine is powered on. Such an initialization causes (block 440) a default first line code (e.g. the code representing the number "2") structured into the ROS 42 to be written into the PIR location 950 to provide for the situation where the operator fails to input such a code.

The invention has been described in detail with reference to a preferred implementation thereof, however, it will be appreciated that modifications and variations are possible with the spirit and scope of the claimed invention.

We claim:

1. A paper indexing device for a typewriter of the kind having a platen that serves in defining a paper feed path and is rotatable to advance paper past a printing line, said indexing device comprising:

a ratchet wheel connected to rotate with said platen;

a pawl moveable to engage and transmit drive motion to said ratchet wheel;

signal activated drive means for moving said pawl in a reciprocating drive motion, follower means coupled to said pawl for influencing the amount of motion transmitted from said pawl to said ratchet wheel in accordance with a follower path;

a first cam that is moveable to define a plurality of individual follower paths corresponding to respective paper indexing rates;

a second cam for defining a follower path corresponding to a preselected paper indexing rate;

means responsive to a control signal, for selecting a cam to define the operative follower path for said follower means whereby a signal-controlled change in paper advance rate is provided which does not disturb the rate selection at said first cam.

2. A paper indexing device according to claim 1 wherein said follower means is a pin attached to said pawl and said first cam is mounted to slide in a direction to modify the portion of a cam profile surface that engages said pin.

3. A paper indexing device according to claim 2 wherein said selecting means is a signal controlled electromagnetic actuator that is positioned to deflect said first cam out of operative engagement withsaid pin a direction different from said direction of sliding.

4. A paper indexing device according to claim 3 wherein resilient means is provided to bias said first cam toward the operative position for defining a follower and said first cam is forceably deflected away from said operative position against this biasing by said actuator.

5. A device for advancing paper into a typewriter of the kind having a platen that defines a paper feed path and which is rotatable to advance paper past a printing line, said device comprising;

a ratchet wheel connected to rotate said platen;

a pawl mounted for reciprocating movement to engage and incrementally rotate said ratchet wheel, the amount of such rotation varying in accordance with the initial point of such engagement;

means for driving said pawl through a movement cycle;

follower means connected to said pawl;

a first cam having a cam profile for cooperating with said follower means to establish said initial engagement point for said pawl, said first cam being mounted for sliding movement in a direction to vary said engagement point;

means for biasing said first cam toward a normal position for operative engagement with said follower means;

a second cam having a cam profile for cooperating with said follower means to establish an initial engagement point for said pawl, said second cam having a generally less prominent profile than said first cam;

means responsive to a control signal for deflecting said first cam away from said normal position to a position out of cooperation with said follower means so that an engagement point is caused to be established by said second cam in cooperation with said follower means.

6. A device according to claim 5 wherein said deflecting means is an electromagnetic actuator that deflects said first cam in a direction generally perpendicular to said direction of sliding.

7. A device according to claim 6 wherein said follower means is a pin that tracks the most prominent cam profile of the operatively positioned cams.

* * * * *